US008277533B2

(12) United States Patent
Farthing et al.

(10) Patent No.: US 8,277,533 B2
(45) Date of Patent: Oct. 2, 2012

(54) POWDER METALLURGY COMPOSITION

(75) Inventors: Leslie John Farthing, Rugby (GB); Paritosh Maulik, Coventry (GB)

(73) Assignee: Federal-Mogul Sintered Products Limited, West Midlands (GB)

( * ) Notice: Subject to any disclaimer, the term of this patent is extended or adjusted under 35 U.S.C. 154(b) by 330 days.

(21) Appl. No.: 12/377,094

(22) PCT Filed: Aug. 9, 2007

(86) PCT No.: PCT/GB2007/003030

§ 371 (c)(1), (2), (4) Date: Apr. 6, 2010

(87) PCT Pub. No.: WO2008/017848

PCT Pub. Date: Feb. 14, 2008

(65) Prior Publication Data

US 2010/0190025 A1 Jul. 29, 2010

(30) Foreign Application Priority Data

Aug. 11, 2006 (GB) ..... 0615929.7

(51) Int. Cl.
*B22F 1/00* (2006.01)
*B22F 3/26* (2006.01)
*B22F 5/00* (2006.01)

(52) U.S. Cl. ..... 75/252; 75/231; 75/246

(58) Field of Classification Search ..... 75/255, 75/252, 246

See application file for complete search history.

(56) References Cited

U.S. PATENT DOCUMENTS

| | | | | |
|---|---|---|---|---|
| 6,802,883 | B2 * | 10/2004 | Henmi et al. | 75/240 |
| 2003/0177863 | A1 * | 9/2003 | Koyama | 75/241 |
| 2004/0069094 | A1 * | 4/2004 | Sato et al. | 75/246 |

FOREIGN PATENT DOCUMENTS

| | | | | |
|---|---|---|---|---|
| EP | 0312161 | A1 | | 10/1988 |
| EP | 0418943 | A1 | | 8/1990 |
| EP | 1026272 | A | | 1/2000 |
| EP | 1347067 | A1 | | 9/2003 |
| JP | 090209095 | | * | 8/1997 |
| WO | WO02/072904 | A | | 9/2002 |

* cited by examiner

*Primary Examiner* — Roy King
*Assistant Examiner* — Ngoclan T Mai
(74) *Attorney, Agent, or Firm* — Robert L. Stearns; Dickinson Wright, PLLC

(57) ABSTRACT

A most preferred composition for the mixture, prior to sintering into an article (ideally a valve seat insert), is as follows: 35% hard phase, 65% matrix (excepting incidental impurities), the hard phase component being 2.2% C, 29.1% Cr, 4.9% Co, 5.3% Ni, 20.2% W with the balance being Fe and allowing less than 2% for one or more machinability aids and solid lubricants, and the matrix component being one of a high chrome steel powder (e.g. 18% Cr, 1% Ni, 2.5% Mo, balance Fe), a low alloy steel powder (3% Cu, 1% C, balance Fe; 3% Cr, 0.5% Mo, 1% C, balance Fe; 4% Ni, 1.5% Cu, 0.5% Mo, 1% C, balance Fe; 4% Ni, 2% Cu, 1.4% Mo, 1% C, balance Fe), or a tool steel powder (5% Mo, 6% W, 4% Cr, 2% V, 1% C, balance Fe), or a low-alloy steel powder as above but which issued in conjunction with a copper infiltration process during sintering.

29 Claims, 2 Drawing Sheets

POWDER METALLURGY COMPOSITION

BACKGROUND OF THE INVENTION

1. Technical Field

This invention relates to an improved powder metallurgy composition, and specifically for an improved powder metallurgy composition suitable for use in sintering processes adapted to manufacture articles for the automotive industry. The invention hereafter described has particular relevance to the manufacture of valve seats, turbocharger bushings, and the like, but of course the invention should not be considered as being limited by the ultimate article into which the composition described herein is ultimately formed by sintering.

2. Related Art

In its simplest form, powder metallurgy is the science of mixing different quantities of powdered elemental metals, alloys, or metals or alloys having been subjected to diffusion bonding so that on sintering such mixtures, articles having desired wear resistance characteristics and stability at the elevated operating temperatures to which the ultimately formed components are often subjected can be cost effectively manufactured.

Powder metallurgy is, in general, is the process of compressing a predetermined powder metallurgical mixture under very great loads to create a what is known as a green compact, and then heating the green compact to a high temperature, often, but not necessarily, between the lowest melting point of any constituent in the mixture and the highest melting point, so as to cause some melting, or movement in terms of diffusion or infiltration, of at least one constituent in the mixture. On cooling (and it is to be mentioned that the heating and cooling stages may be very rapid or quite gradual, depending on the desired physical characteristics of the ultimate product), any residual molten or more fluid constituent solidifies.

It is to be mentioned at this stage that although the following description relates typically to sintering in a protective gas atmosphere or vacuum sintering, the invention has wider application, and indeed it is contemplated by the applicant that the invention could be equally applicable in other manufacturing techniques, such as powder forging, high velocity compaction, and the like.

One of the fundamental aspects of sintering, and in particular the powder metallurgical mixtures used to form sintered articles intended for high wear applications, is the relationship between what is known as the matrix and any hard phase that is incorporated to confer enhanced wear resistance. This relationship is likely to be atomic, structural, mechanical, and chemical, and therefore is fundamentally important in ultimately determining how the finished sintered article will behave in aggressive environments.

The matrix is essentially that substance or composition which effectively binds the overall composition together in the sintered article, said hard phase being dispersed randomly throughout the matrix to provide it with wear resistance characteristics. Accordingly, the matrix material is usually significantly softer than the hard phase, and usually (although not necessarily, depending on application), the concentration by weight of the matrix in the powder mixture, pre-compression, will usually be greater than the corresponding concentration by weight of the hard phase.

It is important to note here that volumetric percentages are sometimes used to express concentrations of constituents in powder mixtures, but these can be very different from the corresponding concentrations by weight, as the densities of the constituent metals or alloys can be significant, particularly as regards the hard phase.

In the remainder of this specification, weight percentage (wt %) is to be assumed unless specifically mentioned otherwise.

In general, the wt % of the hard phase is determined to a large extent by the type of article which is to be made. Valve seat inserts (VSI) typically demand a hard phase concentration of between 25-40 wt % due to the aggressive conditions in the immediate vicinity of internal combustion engine cylinders, whereas turbocharger and other bushings do not have such a high requirement for wear resistance, and accordingly a hard phase of between 8-18% is more common for these applications.

The present invention is to be considered as covering both such applications.

There is much prior art in this particular technological field, and some of the more relevant documents are discussed below.

EP-A-0 418 943, of common ownership herewith, describes sintered steel materials sintered from compacted mixtures comprising a hot working tool steel powder, iron powder and carbon additions in the form of graphite. The hot working tool steel is generally based upon one or more of those known as AISI H11, H12 and H13. Specifically, this patent covers a sintered ferrous material having a wt % composition as follows:

| | |
|---|---|
| C | 0.7-1.3 |
| Si | 0.3-1.3 |
| Cr | 1.9-5.3 |
| Mo | 0.5-1.8 |
| V | 0.1-1.5 |
| Mn | ≦0.6 |
| Fe | the remainder, apart from incidental impurities. |

EP-A-0 312 161, also of common ownership herewith, describes sintered steels made from compacted and sintered mixtures of high-speed tool steels forming the majority of the hard phase, iron powder and carbon additions in the form of graphite forming the majority of the matrix. The high-speed tool steels contemplated for use are generally based on the M3/2 class well known in the art. The sintered steels described in EP-A-0 312 161 are generally of lower carbon content than those described in EP-A-0 418 943. This is due to the fact that the alloying addition levels of the principal carbide forming elements of Mo, V and W are greater in the EP0312161 materials and this maintains the required high degree of wear resistance in applications such as valve seat inserts for example. As a result of the lower carbon level, there is also less of a problem in removing austenite from the structure after sintering. However, the problem with the alloys described in EP-A-0 312 161 is one of material cost due to the relatively high level of alloying additions. EP0312161 thus protects a sintered ferrous-based material having a matrix comprising a pressed and sintered powder, the powder having been pressed to greater than 80% of theoretical density from a mixture including two different ferrous-based powders, the mixture comprising between 40 and 70 wt % of a pre-alloyed powder having a composition in wt %

| | |
|---|---|
| C | 0.45-1.05 |
| W | 2.7-6.2 |
| Mo | 2.8-6.2 |
| V | 2.8-3.2 |
| Cr | 3.8-4.5 |

Others 3 max, with Fe balance, with between 60 and 30 wt % of an iron powder, optionally up to 5 wt % of one or more metallic sulphides, optionally up to 1 wt % of sulphur and carbon powder, such that the total carbon content of the sintered material lies in the range from 0.8 to 1.5 wt %.

As can be seen from the above, the concept of including a high speed tool steel in powder metallurgical compositions is well known.

The above provide examples of situations where very specific compositions are required to achieve a particular purpose or result in a particular sintered article with predetermined wear characteristics.

SUMMARY OF THE INVENTION

It is an object of this invention to provide a powder metallurgical composition for sintering, and articles manufactured therefrom using powder metallurgical processes such as sintering, which utilises widely available, generic matrices, and certain specific hard phase material compositions to provide a sintered article with desired wear resistance characteristics at reasonable cost.

It is a further object of the present invention to provide a sintered steel material which is easier and more economic to manufacture, lower in material cost than comparative prior art materials whilst retaining a comparable level of performance in applications such as valve seat inserts for internal combustion engines for example. However, these criteria apply also to any applications requiring resistance to abrasive wear, and resistance to wear at elevated temperatures.

According to a first aspect of the invention there is provided a powder metallurgy mixture having of a composition (excepting incidental impurities) of between 55-90% iron-based matrix powder, and between 45-10% hard phase powder, characterised in that the 45-10% of the hard phase has a composition (excepting incidental impurities) of at least 30% Fe, with at least some of each of the following elements, the weight % being chosen from the following ranges such that together with the wt. % Fe, the total is 100%:

1-3% C 20-35% Cr 2-22% Co 2-15% Ni 8-25% W,

Preferably, the hard phase composition also includes one or more of the following elements in greater than trace amounts, but not totaling any more than 5% of all such elements:

V

Ni

Ti

Cu

Preferably, the iron-based powder matrix is made up of one of a high chrome steel having between 16-20% Cr, 10-15% Ni, 0.1-5% Mo, 0-2% C, with the remainder being Fe apart from incidental impurities, a low-alloy steel having therein no more than 19.6% total non-iron constituents (other than incidental impurities), said constituents essentially including C in an amount ≦2%, and optionally including one or more of Mo 0-2%, Cu 0-5%, Cr 0-5%, Ni 0-5%, and 0.6% of one or more of Mn, P or S a tool steel powder, the tool steel being of the Tungsten-Molybdenum class tool steels, with 0-2% C, 3-7% Mo, 4-8% W, 2-6% Cr, 0.5-4% V with remaining balance being Fe apart from incidental impurities.

In the case where the iron-based powder matrix is a tool steel powder, the preferred composition is 1% C, 5% Mo, 6% W, 4% Cr, 2% V, with other elements being <0.5% each and the balance being Fe.

In the case where the iron-based powder matrix is a low alloy steel powder, the non-iron components may be:

i. added elementally during mixing, particularly in the case of C, ii. pre-alloyed with the Fe component and provided to the mixture as a pre-alloyed Fe/non Fe metal(s) powder iii. diffusion bonded to the Fe component and provided to the mixture as a diffusion bonded powder comprising Fe and one or more non-Fe metals iv. any combination of the above.

In the case where the iron-based powder matrix is a low-alloy steel powder or a tool steel powder, it is preferable that a copper infiltration technique is used during sintering, the copper being present in an amount 5-30% as a percentage of the composition of the finished article, and further preferably between 8-22%, and yet further preferably between 12-18%.

In a most preferred embodiment, when a copper infiltration technique is used on a material with a matrix of low-alloy steel, composition of the iron-based powder matrix is 3% Cr, 0.5% Mo, 1% C added elementally during mixing, with balance being Fe, with Cu present in an amount of 14% when expressed as a percentage of composition of the finished article.

Preferred compositions of the low-alloy steel are as follows:

i. 3% Cu, 1% C, with balance Fe ii. 3% Cr, 0.5% Mo, 1% C, with balance Fe iii. 4% Ni, 1.5% Cu, 0.5% Mo, 1% C, with balance Fe, or iv. 4% Ni, 2% Cu, 1.4% Mo, 1% C, with balance Fe.

Most preferred compositions of the hard phase component are as follows:

2% C, 23.5% Cr, 19.5% Co, 10.6% Ni, 10.3% W, with Fe balance

2% C, 23.8% Cr, 14.7% Co, 10.7% Ni, 15.5% W with Fe balance

2% C, 24.7% Cr, 9.7% Co, 5.3% Ni, 15.3% W with Fe balance.

In a most preferred embodiment, the composition of the hard phase component is:

1.8% C, 29.8% Cr, 5.1% Co, 5.0% Ni, 20.1% W with Fe balance.

Most preferably, the composition of the matrix component is:

3% Cr pre-alloyed with the Fe, 0.5% Mo pre-alloyed with the Fe, and 1% C added elementally during mixing, with the balance being Fe.

It is yet further preferred that any of the above compositions is also provided with a machinability aid such MnS, optionally having been "pre-alloyed" where MnS is formed in the melt from which one of the powders forming one of the constituents of the matrix or hard phase components is made, and furthermore it is desired that a solid lubricant is added to the composition, selected from the group of: $CaF_2$, $MoS_2$, talc, free graphite flakes, BN and BaF2.

Both the machinability aid and the solid lubricant may be provided in amounts not greater than 5% each, and the various other prescribed percentages of constituents mentioned above may be reduced so that the total of all percentages of all constituents in one composition is 100%.

According to a second aspect of this invention, there is provided an article made by performing a powder metallurgical process on the composition above, such as by sintering.

It is also envisaged that the above hard phase compositions may be made by a variety of different methods, including grinding a metal or alloy ingot, by one or more of oil, gas, air, or water atomisation, or by the known Coldstream™ process, although gas atomisation is the most preferred method.

The abovementioned invention is of great advantage as regards existing metal/alloy powder compositions used in sintering because of the absence of Molybdenum in the hard phase component. It is well known that, while Mo is known to confer very good wear resistance characteristics to hard phases in the final sintered article, it is notoriously expensive, and the compositions thus provided above are comparatively wear resistant while simultaneously being significantly less expensive.

BRIEF DESCRIPTION OF THE DRAWINGS

The invention will now be described by way of example with reference to the accompanying drawings, wherein.

DETAILED DESCRIPTION

Figure 1:
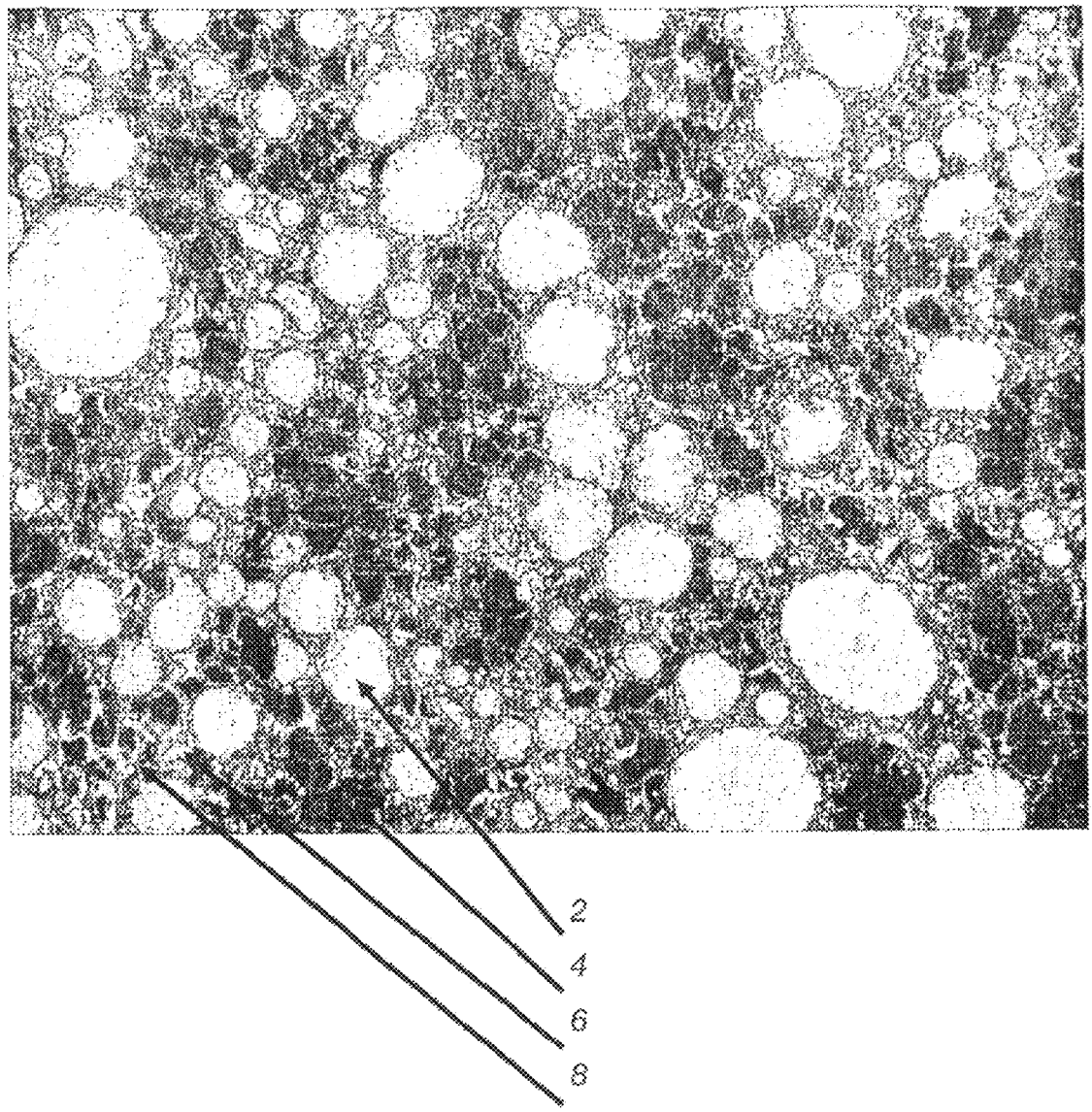
FIG. 1 shows a magnified cross-section through a sintered component made from a mixture according to the present invention, FIGS. 2, 3, 4 provide comparative wear statistics for components made from a mixtures according to the present invention, and currently available mixtures/products.

Referring firstly to FIG. 1 there is shown a high resolution image of a surface of a component manufactured from a mixture including 63% low-alloy steel powder, specifically 3% Cr pre-alloyed with the Fe, 0.5% Mo pre-alloyed with the Fe, and 1% C added elementally during mixing with the balance being Fe, and 35% hard phase powder, specifically 1.8% C, 29.8% Cr, 5.1% Co, 5.0% Ni, 20.1% W with Fe balance, and 2% MnS. The material was infiltrated with copper during the sintering process. The various phases have been labelled thus:

2—hard phase
4—matrix
6—copper (infiltrated)
8—MnS, machinability aid.

Figure 2:
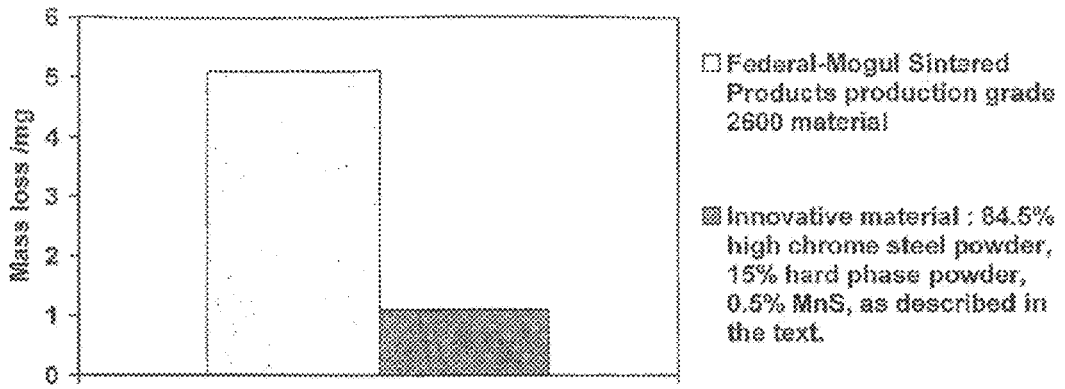

Referring to FIG. 2 there is shown wear test results for a material formed from 84.5% high chrome steel powder, specifically 18% Cr pre-alloyed with the Fe, 12% Ni pre-alloyed with the Fe, 2.5% Mo pre-alloyed with the Fe, and 1.5% C added elementally during mixing with the balance being Fe, and 15% hard phase powder, specifically 1.8% C, 29.8% Cr, 5.1% Co, 5.0% Ni, 20.1% W with Fe balance, and 0.5% MnS. This material was pressed to a density of 6.6 g/cm3 and vacuum sintered with a 30 minute dwell at a temperature of 1200° C. The wear test involved rubbing the surface of the sintered material with a reciprocating stainless steel contact in the form of an ¼" ball. The test lasted 3 hours at 600° C. in air and a load of 2 kg was applied. This wear test can be used to compare the wear resistance of different turbocharger bushing materials. FIG. 2 shows the mass loss of the material described above, and this is compared with the mass loss of a commercially available turbocharger bushing material currently produced by Federal-Mogul Sintered Products. This current production material is designated as Materials Grade 2600 by Federal-Mogul Sintered Products, and it doesn't contain any deliberate hard phase powder additions. The benefit of the hard phase powder addition can be clearly seen.

Figure 3:
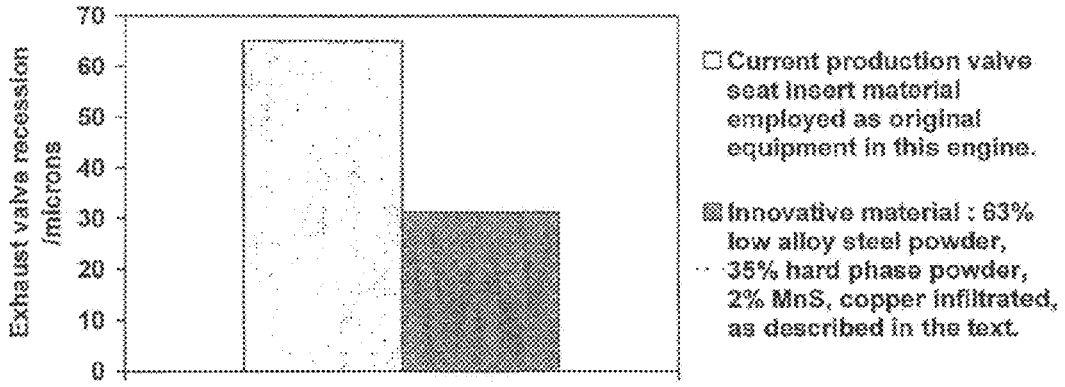

Referring to FIG. 3 there is shown wear test results for a material formed from 63% low-alloy steel powder, specifically 3% Cr pre-alloyed with the Fe, 0.5% Mo pre-alloyed with the Fe, and 1% C added elementally during mixing with the balance being Fe, and 35% hard phase powder, specifically 1.8% C, 29.8% Cr, 5.1% Co, 5.0% Ni, 20.1% W with Fe balance, and 2% MnS. This material was pressed to a density of 7 g/cm3 and sintered in a 10% H2/90% N2 atmosphere with a 30 minute dwell at a temperature of 1110° C. The pressed parts were infiltrated with copper during the sintering process. The sintered articles were then machined into the form of exhaust valve seat inserts, and fitted into a 2 litre diesel engine cylinder head. This cylinder head was then fitted to an engine and operated for 390 hours under a mixed test cycle. FIG. 3 shows the average recession of the exhaust valves, where this recession is the result of combined wear of the valve seat insert and valve. The level of valve recession is also compared to that for the current production valve seat insert material employed as original equipment in this engine. The composition of this original equipment material isn't fully known, since it is a proprietary manufactured product, but it is known to have a low-alloy steel matrix, and contain a hard phase that is believed to contain 30% Mo, and it is also copper infiltrated. The superior behaviour of this invention can be clearly seen.

Figure 4:
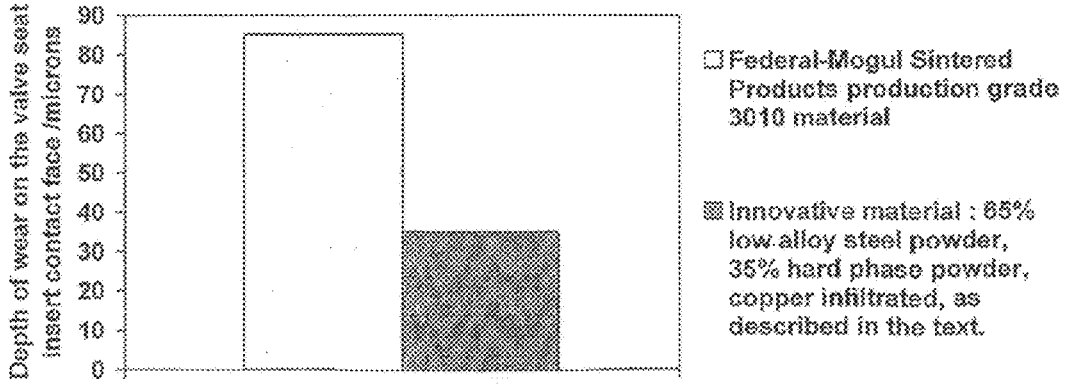

Referring to FIG. 4 there is shown wear test results for a material formed from 65% low-alloy steel powder, specifically 3% Cu added elementally during mixing and 1% C added elementally during mixing with the balance being Fe, and 35% hard phase powder, specifically 1.8% C, 29.8% Cr, 5.1% Co, 5.0% Ni, 20.1% W with Fe balance. This material was pressed to a density of 7 g/cm3 and sintered in a 10% H2/90% N2 atmosphere with a 30 minute dwell at a temperature of 1110° C. The pressed parts were infiltrated with copper during the sintering process. The sintered articles were then machined into the form of valve seat inserts, and evaluated in a valve seat insert rig test. In this rig test a valve seat insert and valve are assembled into a fixture that is designed to replicate the layout and operation of these components in an actual engine. The valve is moved up and down to contact the valve seat insert in the same manner as in a conventional cylinder head. The test was conducted at 150° C. and lasted 5 hours, with the valve reciprocating at a speed of 3000 rpm. FIG. 4 shows the average depth of wear on the valve seat insert contact face. Comparative data is also shown for a commercially valve seat insert material currently produced by Federal-Mogul Sintered Products. This current production material is designated as Materials Grade 3010 by Federal-Mogul Sintered Products, and it doesn't contain any deliberate hard phase powder additions. The benefit of the hard phase powder addition can be clearly seen.

The applicant herefor considers the above sintering processes and parameters therefor as aspects of the invention.

The invention claimed is:

1. A powder metallurgy mixture having a composition, in weight percentage (wt %) of the powder metallurgy mixture, excepting incidental impurities, of between 55-90 wt % iron-based matrix powder, between 45-10 wt % hard phase powder, optionally a machinability aid, optionally a solid lubricant selected from the group of: $CaF_2$, $MoS_2$, talc, free graphite flakes, BN and $BaF_2$, wherein the machinability aid and the solid lubricant are provided in amounts not greater than 5 wt % each, the above constituents together total 100 wt % of the powder metallurgy mixture, and the hard phase powder has a composition, in weight percentage (wt %) of the hard phase powder, excepting incidental impurities, of at least 30 wt % Fe:

1-3 wt % C 20-35 wt % Cr 2-22 wt % Co 2-15 wt % Ni 8-25 wt % W optionally one or more of the following elements in greater than trace amounts, but not totaling any more than 5 wt % of all such elements: V, Ti, Cu, and the balance being Fe.

2. A mixture according to claim 1 wherein the iron-based matrix powder is a high chrome steel and has a composition, in weight percentage (wt %) of the iron-based matrix powder, between 16-20 wt % Cr, 10-15 wt % Ni, 0.1-5 wt % Mo, 0-2 wt % C, with the remainder being Fe apart from incidental impurities.

3. A mixture according to claim 1 wherein the iron-based matrix powder is a low-alloy steel powder and has a composition, in weight percentage (wt %) of the iron-based matrix powder, no more than 19.6 wt % total non-iron constituents, other than incidental impurities, said constituents essentially including C in an amount ≦2 wt %, and optionally including one or more of Mo 0-2 wt %, Cu 0-5 wt %, Cr 0-5 wt %, Ni 0-5 wt %, and 0.6 wt % of one or more of Mn, P or S.

4. A mixture according to claim 1 wherein the iron-based matrix powder is a tool steel powder, the tool steel being of the Tungsten-Molybdenum class tool steels, and has a composition, in weight percentage (wt %) of the iron-based matrix powder, 0-2 wt % C, 3-7 wt % Mo, 4-8 wt % W, 2-6 wt % Cr, 0.5-4 wt % V with remaining balance being Fe apart from incidental impurities.

5. A mixture according to claim 4 wherein the composition is 1 wt % C, 5% Mo, 6 wt % W, 4 wt % Cr, 2 wt % V, with the incidental impurities being <0.5 wt % each and the balance being Fe.

6. A mixture according to claim 3 wherein the non-iron components are:

i. added elementally during mixing, ii. pre-alloyed with the Fe component and provided to the mixture as a pre-alloyed Fe/non Fe metal(s) powder iii. diffusion bonded to the Fe component and provided to the mixture as a diffusion bonded powder comprising Fe and one or more non-Fe metals iv. any combination of the above.

7. A sintered product comprising the mixture as defined in claim 3, wherein the mixture is sintered and infiltrated with copper, the copper being present in an amount 5-30 wt % as a percentage of the composition of the finished sintered product after completion of the sintering process.

8. A sintered product according to claim 7 wherein the copper is present in amount between 8-22 wt % as a percentage of the finished sintered product after completion of the sintering process.

9. A sintered product according to claim 7 wherein the copper is present in amount between 12-18 wt % as a percentage of the finished sintered product after completion of the sintering process.

10. A sintered product according to claim 7, wherein the composition of the iron-based powder matrix powder is 3 wt % Cr, 0.5 wt % Mo, 1 wt % C added elementally during mixing, with balance being Fe, with Cu present in an amount of 14 wt % when expressed as a percentage of composition of the finished sintered product after completion of the sintering process.

11. A mixture according to claim 3 wherein the compositions of the low-alloy steel are chosen form one of the following:

i. 3 wt % Cu, 1% C, with balance Fe ii. 3 wt % Cr, 0.5 wt % Mo, 1 wt % C, with balance Fe iii. 4 wt % Ni, 1.5 wt % Cu, 0.5 wt % Mo, 1 wt % C, with balance Fe, or iv. 4 wt % Ni, 2 wt % Cu, 1.4 wt % Mo, 1 wt % C, with balance Fe.

12. A mixture according to claim 1 wherein the composition of the hard phase component in said mixture is chosen from the following:

2 wt % C, 23.5 wt % Cr, 19-5 wt % Co, 10.6 wt % Ni, 10.3 wt % W, with Fe balance 2 wt % C, 23.8 wt % Cr, 14.7 wt % Co, 10.7 wt % Ni, 15.5 wt % W with Fe balance 2 wt % C, 24.7 wt % Cr, 9.7 wt % Co, 5.3 wt % Ni, 15.3 wt % W with Fe balance.

13. A mixture according to claim 1 wherein the composition of the hard phase component is:

1.8 wt % C, 29.8 wt % Cr, 5.1 wt % Co, 5.0 wt % Ni, 20.1 wt % W with Fe balance.

14. A mixture according to claim 1 wherein the composition of the iron-based matrix powder is, in weight percentage (wt %) of the iron-based matrix powder:

3 wt % Cr pre-alloyed with the Fe, 0.5 wt % Mo pre-alloyed with the Fe, and 1 wt % C added elementally during mixing, with the balance being Fe.

15. A mixture according to claim 1 wherein the powder metallurgy mixture includes the machinability aid, and the machinability aid is MnS.

16. A mixture according to claim 15 wherein the MnS has been pre-alloyed in that the MnS has been formed in the melt from which one of the powders forming one of the constituents of the iron-based matrix powder or hard phase components is made.

17. A mixture according to claim 1 wherein the solid lubricant is added to the composition and the solid lubricant is, selected from the group consisting of: $CaF_2$, $MoS_2$, talc, free graphite flakes, BN and $BaF_2$.

18. A mixture according to claim 1 wherein the machinability aid and the solid lubricant are added to the composition.

19. A mixture according to claim 1 wherein the hard phase powder compositions are made by one or more of the following methods:

grinding a metal or alloy ingot, and by one or more of oil, gas, air, or water atomization.

20. An article made by compaction, heating and cooling from a powder metallurgy mixture as defined in claim 1.

21. A sintered valve seat insert, made from a mixture as defined in claim 1.

22. A sintered valve seat insert according to claim 21, wherein the mixture is sintered and infiltrated with copper, the copper being present in an amount 5-30 wt % as a percentage of the composition of the finished sintered mixture after completion of the sintering process.

23. A powder metallurgy mixture having a composition, in weight percentage (wt %) of the powder metallurgy mixture, excepting incidental impurities, of between 55-90 wt % iron-based matrix powder, and between 45-10 wt % hard phase powder, wherein the hard phase powder has a composition, in weight percentage (wt %) of the hard phase powder, excepting incidental impurities, of at least 30 wt % Fe:

1-3 wt % C 20-35 wt % Cr 2-22 wt % Co 2-15 wt % Ni 8-25 wt % W, and the iron-based matrix powder is a high chrome steel and has a composition, in weight percentage (wt %) of the iron-based matrix powder, between 16-20 wt % Cr, 10-15 wt % Ni, 0.1-5 wt % Mo, 0-2 wt % C, with the remainder being Fe apart from incidental impurities.

24. A sintered product including a powder metallurgy mixture having a composition, in weight percentage (wt %) of the powder metallurgy mixture, excepting incidental impurities, of between 55-90 wt % iron-based matrix powder, and between 45-10 wt % hard phase powder, wherein the hard phase powder has a composition, in weight percentage (wt %) of the hard phase powder, excepting incidental impurities, of at least 30 wt % Fe:

1-3 wt % C 20-35 wt % Cr 2-22 wt % Co 2-15 wt % Ni 8-25 wt % W, and the iron-based matrix powder is a low-alloy steel powder and has a composition, in weight percentage (wt %) of the iron-based matrix, no more than 19.6 wt % total non-iron constituents, other than incidental impurities, said constituents essentially including C in an amount ≦2 wt %, and optionally including one or more of Mo 0-2 wt %, Cu 0-5 wt %, Cr 0-5 wt %, Ni 0-5 wt %, and 0.6 wt % of one or more of Mn, P or S, and the mixture is sintered and infiltrated with copper, the copper being present in an amount 5-30 wt % as a percentage of the composition of the finished sintered product after completion of the sintering process.

25. A sintered product according to claim 24 wherein the copper is present in amount between 8-22 wt % as a percentage of the finished product after completion of the sintering process.

26. A sintered product according to claim 24 wherein the copper is present in amount between 12-18 wt % as a percentage of the finished product after completion of the sintering process.

27. A sintered product according to claim 24, wherein the composition of the iron-based powder matrix is 3 wt % Cr, 0.5 wt % Mo, 1 wt % C added elementally during mixing, with balance being Fe, with Cu present in an amount of 14 wt % when expressed as a percentage of composition of the finished product after completion of the sintering process.

28. A powder metallurgy mixture having a composition, in weight percentage (wt %) of the powder metallurgy mixture, excepting incidental impurities, of between 55-90 wt % iron-based matrix powder, and between 45-10 wt % hard phase powder, wherein the hard phase powder has a composition, in weight percentage (wt %) of the hard phase powder, excepting incidental impurities, of at least 30 wt % Fe:

1-3 wt % C 20-35 wt % Cr 2-22 wt % Co 2-15 wt % Ni 8-25 wt % W, and the iron-based matrix powder is a low-alloy steel powder and has a composition, in weight percentage (wt %) of the iron-based matrix, chosen from one of the following:

i. 3 wt % Cu, 1% C, with balance Fe ii. 3 wt % Cr, 0.5 wt % Mo, 1 wt % C, with balance Fe iii. 4 wt % Ni, 1.5 wt % Cu, 0.5 wt % Mo, 1 wt % C, with balance Fe, or iv. 4 wt % Ni, 2 wt % Cu, 1.4 wt % Mo, 1 wt % C, with balance Fe.

29. A powder metallurgy mixture having a composition, in weight percentage (wt %) of the powder metallurgy mixture, excepting incidental impurities, of between 55-90 wt % iron-based matrix powder, and between 45-10 wt % hard phase powder, wherein the hard phase powder has a composition, in weight percentage (wt %) of the hard phase powder, excepting incidental impurities, of at least 30 wt % Fe:

1-3 wt % C 20-35 wt % Cr 2-22 wt % Co 2-15 wt % Ni 8-25 wt % W, and the composition of the iron-based matrix powder is, in weight percentage (wt %) of the iron-based matrix powder:

3 wt % Cr pre-alloyed with the Fe, 0.5 wt % Mo pre-alloyed with the Fe, and 1 wt % C added elementally during mixing, with the balance being Fe.

* * * * *